US011598086B2

(12) United States Patent
Onishi

(10) Patent No.: US 11,598,086 B2
(45) Date of Patent: Mar. 7, 2023

(54) JOINT STRUCTURE FOR H-BEAM

(71) Applicant: BUILDING SYSTEM DESIGN CO., LTD, Tokyo (JP)

(72) Inventor: Katsunori Onishi, Tokyo (JP)

(73) Assignee: BUILDING SYSTEM DESIGN CO., LTD., Tokyo (JP)

( * ) Notice: Subject to any disclaimer, the term of this patent is extended or adjusted under 35 U.S.C. 154(b) by 56 days.

(21) Appl. No.: 16/754,867

(22) PCT Filed: Oct. 11, 2018

(86) PCT No.: PCT/JP2018/037911
§ 371 (c)(1),
(2) Date: Apr. 9, 2020

(87) PCT Pub. No.: WO2019/074050
PCT Pub. Date: Apr. 18, 2019

(65) Prior Publication Data

US 2020/0318342 A1 Oct. 8, 2020

(30) Foreign Application Priority Data

Oct. 13, 2017 (JP) ..... JP2017-199349

(51) Int. Cl.
*E04B 1/58* (2006.01)
*E04B 1/24* (2006.01)

(52) U.S. Cl.
CPC ..... *E04B 1/5812* (2013.01); *E04B 1/2403* (2013.01); *E04B 2001/5875* (2013.01)

(58) Field of Classification Search
CPC .... E04B 1/2403; E04B 1/5812; E04B 1/5806; E04B 2001/2406; E04B 2001/2415;
(Continued)

(56) References Cited

U.S. PATENT DOCUMENTS 3,593,477 A * 7/1971 Briggs ..... E04B 1/185 52/253
3,977,801 A * 8/1976 Murphy ..... E04B 1/2403 248/188

(Continued)

FOREIGN PATENT DOCUMENTS

CN 105569204 A * 5/2016 ..... E04B 1/98
CN 108193832 A * 6/2018 ..... E04C 3/06

(Continued)

OTHER PUBLICATIONS

International Search Report dated Jan. 8, 2019 in International (PCT) Application No. PCT/JP2018/037911.

*Primary Examiner* — Kyle J. Walraed-Sullivan
(74) *Attorney, Agent, or Firm* — Wenderoth, Lind & Ponack, L.L.P.

(57) ABSTRACT

An H-beam joint structure for joining ends of H-beam steel materials adjacent to each other. The steel materials have a flange and a web. The joint structure includes: a transmission plate arranged parallel to a front surface of the web on at least one side of the web of the H-beam and the steel material, and welded to a back surface of the flange; and a coupling plate provided in close contact with the transmission plate to connect the H-beam and the steel material. A web of the H-beam, the web of the steel material and the transmission plate are bolted via the coupling plate. As a result, there is provided an H-beam joint structure which has a joining strength equivalent to a conventional joint structure for an H-beam, and also which can easily be constructed to have less parts and make front surfaces of the flanges flat.

9 Claims, 20 Drawing Sheets

(58) Field of Classification Search
CPC ..... E04B 2001/2424; E04B 2001/2445; E04B 2001/2448; E04B 2001/2454; E04B 2001/2457; E04B 2001/246; E04B 2001/2469; E04B 2001/2472; E04B 2001/2418; E04B 2001/2451; E04B 2001/5875; E04B 2103/06; E04B 1/5818
See application file for complete search history.

(56) References Cited

U.S. PATENT DOCUMENTS 4,014,089 A * 3/1977 Sato ..... E04B 1/2403 29/525.11
5,577,353 A * 11/1996 Simpson ..... E04B 7/022 403/170
5,660,017 A * 8/1997 Houghton ..... E04B 1/2403 52/167.3
6,073,405 A * 6/2000 Kasai ..... E04B 1/2403 403/270
6,138,427 A * 10/2000 Houghton ..... E04B 1/2403 52/236.3
6,237,303 B1 * 5/2001 Allen ..... E04B 1/2403 52/653.1
6,802,169 B2 * 10/2004 Simmons ..... E04B 1/24 52/648.1
6,829,872 B2 * 12/2004 Wahlsteen ..... E04B 1/2403 52/741.1
8,161,707 B2 * 4/2012 Simmons ..... E04C 3/32 52/648.1
9,249,593 B2 * 2/2016 Perko ..... E04H 9/145
2002/0184836 A1 * 12/2002 Takeuchi ..... E04C 3/04 52/167.1
2003/0009977 A1 * 1/2003 Houghton ..... E04C 3/32 52/656.9
2004/0050013 A1 * 3/2004 Okada ..... E04B 1/2403 52/848
2004/0093825 A1 * 5/2004 Lee ..... E04C 3/32 52/843
2004/0244330 A1 * 12/2004 Takeuchi ..... E04B 1/2403 52/831
2005/0204684 A1 * 9/2005 Houghton ..... E04B 1/24 52/653.1
2006/0144006 A1 * 7/2006 Suzuki ..... E04H 9/024 52/655.1
2008/0022624 A1 * 1/2008 Hanson ..... E04B 5/10 52/702
2008/0060876 A1 * 3/2008 Henderson ..... E04B 1/2403 182/186.8
2009/0223166 A1 * 9/2009 Ohata ..... E04B 1/2403 52/699
2011/0030305 A1 * 2/2011 Karns ..... E04B 1/2403 52/650.1
2014/0007541 A1 * 1/2014 Hill ..... E04B 1/40 52/655.1
2014/0083042 A1 3/2014 Hiragaki
2014/0325932 A1 * 11/2014 Tran ..... E04C 3/06 52/700
2015/0159369 A1 * 6/2015 Chen ..... E04B 1/2403 52/167.8
2015/0275501 A1 * 10/2015 Houghton ..... E04H 9/024 52/854
2016/0002910 A1 * 1/2016 Green ..... F16B 7/0446 52/848
2018/0274223 A1 * 9/2018 Richards ..... E04H 9/021
2018/0347222 A1 * 12/2018 Richards ..... E04H 9/021
2019/0186165 A1 * 6/2019 Pall ..... E04H 9/024
2020/0056370 A1 * 2/2020 Hebiishi ..... E04B 1/58
2021/0207358 A1 * 7/2021 Jin ..... E04B 1/2403

FOREIGN PATENT DOCUMENTS

JP 05-179703 7/1993
JP 06-173340 6/1994
JP 07-34551 2/1995
JP 2006-051522 2/2006

* cited by examiner

JOINT STRUCTURE FOR H-BEAM

TECHNICAL FIELD

The present invention relates to an H-beam joint structure.

BACKGROUND ART

In architectural structures such as buildings, structural materials such as steel frames are used for their frames. In general, an H-beam is commonly used as such a structural material from the viewpoint of flexural rigidity, flexural strength, and the like, and these are joined according to the design of the building to form a building structure.

In the construction of a building structure, a joint structure as illustrated in FIG. 20 is conventionally used for joining an H-beam. In this joint structure, the bending moment applied to ends of adjacent H-beams 10 and 11 is transmitted as an axial force mainly to the cross section of a flange 12. Hence, the flanges 12 of the adjacent H-beams 10 and 11 are held by putting attachment plates 8 on each of the front and back surfaces of the flanges 12 so that the axial force is transmitted in the axial force direction, and the H-beams 10 and 11 are frictionally joined by tightening them with bolts 6 and nuts 7 on the two friction surfaces.

The shearing force applied to the H-beams 10 and 11 is transmitted as a shearing force in the vertical direction mainly to the cross section of a web 13. Hence, the webs 13 are held by putting attachment plates 9 on both surfaces of the web 13 so that the shearing force is transmitted to the web 13 of the adjacent H-beams 10 and 11, and the H-beams 10 and 11 are frictionally joined by tightening them with bolts 6 and nuts 7 on the two friction surfaces. Furthermore, the axial force applied to the H-beams 10 and 11 is transmitted by both joints between the flanges 12 and between the webs 13.

Retention of a high joining strength between the adjacent H-beams 10 and 11 in such a conventional joint structure requires a large number of the attachment plates 8 and 9 and a large number of the bolts 6 and nuts 7 for fixing the attachment plates 8 and 9. Therefore, there has been a problem that the number of components to be used is very large, which increases the cost, and a large amount of efforts is required for joining.

In order to solve this problem, a method in which an L-beam is used to join H-beams by abutting on the inner side surface of the flange and the side surface of the web, and joining the L-beam by bolts has been proposed (See Patent Literature 1). According to this proposal, the number of attachment plates can be reduced while retaining the joining strength. However, since the number of bolts used is the same as that of the conventional one, the cost is high, and the workability is low as in the conventional one.

On the other hand, in the conventional joint structure illustrated in FIG. 20 in which the front surface and the back surface of the flanges 12 of the adjacent H-beams 10 and 11 are held by two attachment plates and tightened by the bolts 6 and the nuts 7, the head of the bolt 6, the nut 7, and the attachment plate 8 inevitably project on the front surface side of the flange 12. Here, in the case of constructing another part such as a floor on the front surface side of the flange 12 of the joint portion in such a joint structure, the head of the bolt 6, the nut 7, and the attachment plate 8 that project become an obstacle, and a design for avoiding them becomes necessary. Hence, has been desired that the front surface side of the flange 12 is flat.

In order to solve such a problem, in Patent Literature 1, the attachment plate on the back side of the flange and half of the web attachment plate are integrated into an L-shape. However, they both are used as an attachment plate of the flange, and thus the joint of the bolt with the flange is essential, and the bolt projection to the outer surface of the flange has not been solved.

Therefore, a proposal in which end plates are welded to the end faces of H-beams to be joined, and the end plates are fixed to each other with bolts and nuts has been made (See Patent Literature 2). According to this proposal, it is possible to provide a structure that is low in the number of components, excellent in the workability, and free from projection of the head of the bolt and the nut on the flange surface.

As another method for eliminating projection from the flange surface, a proposal has been made in which a thick plate steel having a recess for sinking the bolt head is integrally formed at the tip of the upper flange by complete penetration welding, and, at the site, an attachment plate for transmitting the force of the flange is arranged inside the flange, and is joined with a through bolt (See Patent Literature 3).

CITATION LIST

Patent Literature

[Patent Literature 1] JP 7-34551A
[Patent Literature 2] JP 5-179703A
[Patent Literature 3] JP 6-173340A

SUMMARY OF INVENTION

Technical Problem

However, in the method of joint of the end plates provided at the ends of the H-beam by bolts in the proposal of Patent Literature 2, the axial direction of the bolts is an out-of-plane direction of the end plates, and hence slight deformation cannot be avoided even if the thick plates are used to reduce deformation, and also slight deformation is applied in the tensile joint of the high-strength bolts, making it difficult perfect rigid joint as in the conventional attachment plate method illustrated in FIG. 20.

Furthermore, in the proposal of Patent Literature 3, there are problems such as that a thick plate having a recess is expensive, that the complete penetration welding of a component and an H-beam flange costs high, and that the number of bolts is required to be nearly twice as large as that required in the conventional two-face shear friction joint because the friction surface with the attachment plate is one-face shear friction joint.

The present invention has been made in view of the circumstances described above, and it is an object of the present invention to provide an H-beam joint structure having a joining strength equivalent to that of a conventional H-beam joint structure, capable of reducing the number of components, facilitating the joining work, and capable of flattening the front surface side of the flange.

Solution to Problem

The H-beam joint structure according to the present invention has been made in order to solve the above technical problem, and is characterized in the following.

First, an H-beam joint structure for joining an end of steel materials adjacent to H-beam each other, wherein the steel materials have a flange and a web, comprising:

a transmission plate arranged parallel to a front surface of the web on at least one side of the web of the H-beam and the steel material, and welded to a back surface of the flange; and a coupling plate provided in close contact with the transmission plate to connect the H-beam and the steel material, wherein a web of the H-beam, the web of the steel material and the transmission plate are bolted via the coupling plate.

Second, an H-beam joint structure for joining an end of steel materials adjacent to H-beam each other, wherein the steel materials have a flange and a web, comprising:

a transmission plate arranged parallel to a front surface of the web on at least one side of the web of the H-beam and the steel material, and welded to a back surface of the flange; and a coupling plate connecting the H-beam and the steel material on an opposite side to the web on a side where the transmission plate is arranged, wherein a web of the H-beam, the web of the steel material and the transmission plate are bolted via the coupling plate.

Third, in the H-beam joint structure according to the first or second invention, it is preferable that the transmission plates of the H-beam and the steel material are arranged in close contact with the front surface of the web, and the coupling plate is arranged in close contact with the front surface of the transmission plate or the front surface of the web.

Fourth, in the H-beam joint structure according to the first or second invention, it is preferable that the transmission plates of the H-beam and the steel material are arranged by being welded to the back surface of the flange at an interval corresponding to the thickness of the coupling plate from the front surface of the web, and the coupling plate is arranged so as to be held in close contact between the transmission plate and the web.

Fifth, in the H-beam joint structure according to the first or second invention, it is preferable that a plurality of the transmission plates of the H-beam and the steel material are arranged at an interval corresponding to the thickness of the coupling plate, and the coupling plate is arranged so as to be held in close contact between the web and the transmission plate and/or between the plurality of transmission plates.

Sixth, in the H-beam joint structure according to the first or second invention, it is preferable that a shearing coupling plate connecting the upper and lower transmission plates and the upper and lower coupling plates of the H-beam and the steel material is provided between the upper and lower transmission plates and the upper and lower coupling plates of the H-beam and the steel material.

Seventh, in the H-beam joint structure according to the first to sixth inventions, it is preferable that the steel material is any of an H-beam, a channel steel, a Z-beam, and an I-beam.

Eighth, the H-beam joint structure according to the present invention is an H-beam joint structure for joining an H-beam and a structure, and the H-beam joint structure includes a transmission plate arranged parallel to a front surface of a web on at least one side of the web of the H-beam, and welded to a back surface of the flange, and a coupling plate provided in close contact with the transmission plate to connect the H-beam and the structure, in which a part of the coupling plate is welded or bolted to the structure, and at least one end is bolted to the web of the H-beam and the transmission plate.

Ninth, the H-beam joint structure according to the present invention is an H-beam joint structure for joining an H-beam and a structure, and the H-beam joint structure includes a transmission plate arranged parallel to a front surface of a web on at least one side of the web of the H-beam, and welded to a back surface of the flange, and a coupling plate connecting the H-beam and the structure on an opposite side to the web on the side where the transmission plate is arranged, in which a part of the coupling plate is welded or bolted to the structure, and at least one end is bolted to the web of the H-beam web and the transmission plate.

Tenth, in the H-beam joint structure according to the eighth or ninth invention, it is preferable that the transmission plate of the H-beam is arranged in close contact with the front surface of the web, the coupling plate is welded to the structure, and at least one end of the coupling plate is arranged in close contact with the front surface of the transmission plate or the front surface of the web.

Eleventh, in the H-beam joint structure according to the eighth or ninth invention, it is preferable that the transmission plate of the H-beam is arranged by being welded to the back surface of the flange at an interval corresponding to the thickness of the coupling plate from the front surface of the web, and the coupling plate is welded to the structure and at least one end of the coupling plate is arranged so as to be held in close contact between the transmission plate and the web.

Twelfth, in the H-beam joint structure according to the eighth or ninth invention, it is preferable that a plurality of the transmission plates of the H-beam are arranged at an interval corresponding to the thickness of the coupling plate, and the coupling plate is welded to the structure and at least one end of the coupling plate is arranged so as to be held in close contact between the web and the transmission plate and/or between the plurality of transmission plates.

Thirteenth, in the H-beam joint structure according to the eighth to twelfth inventions, it is preferable that the structure is any of an H-beam, a channel steel, a Z-beam, an I-beam, a square steel tube, and a foundation anchor plate.

Advantageous Effects of Invention

According to the H-beam joint structure of the present invention, it is possible to have a joining strength equivalent to that of a conventional H-beam joint structure, to reduce the number of components, to facilitate the joining work, and to flatten the front surface side of the flange.

DESCRIPTION OF EMBODIMENTS

Figure 1:
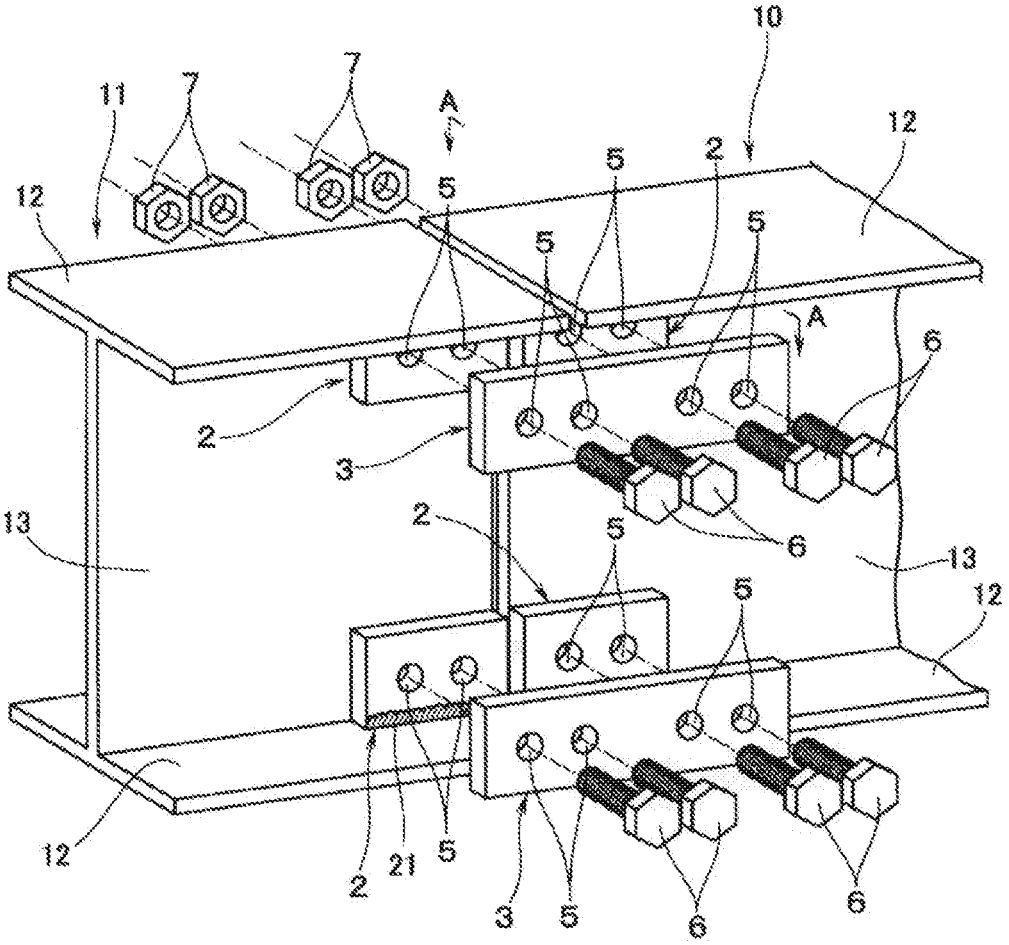
FIG. 1 is an exploded perspective view illustrating a first embodiment of an H-beam joint structure of the present invention.

The H-beam joint structure of the present invention will be described in detail below with reference to the drawings. FIG. 1 is an exploded perspective view illustrating an embodiment of the H-beam joint structure of the present invention, and FIG. 2 is an A-A cross-sectional view of the embodiment of FIG. 1 after joining.

The H-beam joint structure according to the present invention is an H-beam joint structure for joining an end of an H-beam 10 and an end of a steel material 11 that is adjacent to the H-beam 10 and has at least a flange 12 and a web 13, and the H-beam joint structure includes a transmission plate 2 arranged parallel to a front surface of the web 13 at least one side of the web 13 of the H-beam 10 and the steel material 11, and welded to a back surface of the flange 12, and a coupling plate 3 provided in close contact with the transmission plate 2 to connect the H-beam 10 and the steel material 11. The web 13 and the transmission plate 2 of the H-beam 10 are bolted to those of the steel material 11 via the coupling plate 3.

First Embodiment

Figure 2:
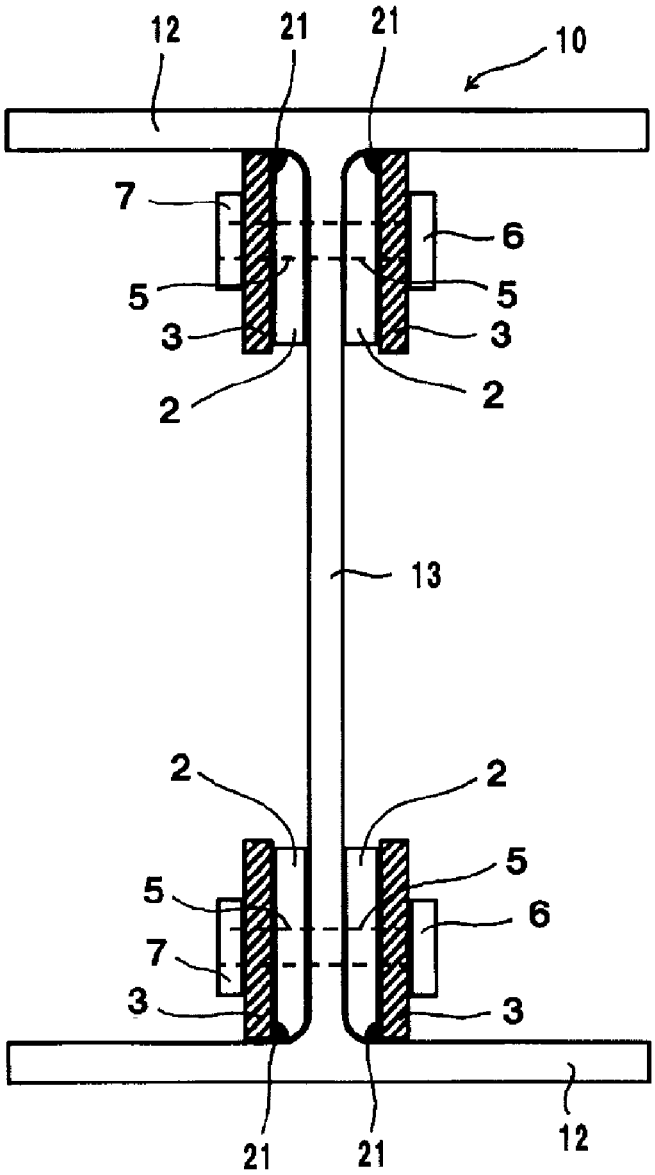
FIG. 2 is an A-A cross-sectional view of the first embodiment of FIG. 1 after joining.

FIGS. 1 and 2 illustrate the H-beam joint structure according to the first embodiment in a state where the H-beam 10 and an H-beam 11 as an adjacent steel material are joined, and the transmission plate 2 is welded along a longitudinal direction of the back surface of the flange 12 and provided so as to come into close contact with the front surface of the web 13.

The H-beam 10 includes upper and lower flanges 12 and one web 13 vertically connecting the cross-section center parts of the respective flanges 12. Furthermore, the adjacent H-beam 11 to be joined has an H-shape having substantially the same cross sections. The adjacent H-beam 11 in the present invention may have a cross-sectional shape different from that of the H-beam 10. Alternatively, each may be a long H-beam member or a short H-beam member, one of which is joined horizontally or at a predetermined angle from a columnar steel material. Such H-beam joints can be used for linear joints such as beams, columns, and bracings.

The cross-sectional shape of the transmission plate 2 is a shape that is in close contact with the cross-sectional shape of the joint between the flange 12 and the web 13, and for example, when the joint between the flange 12 and the web 13 is formed into a cross-sectional circular arc shape, the shape of the corresponding edge of the transmission plate 2 is also formed into a cross-sectional circular arc shape or a chamfered shape that is in close contact with the joint.

The transmission plate 2 and the flange 12 are welded so that a force is transmitted to both the edge of the transmission plate 2 and the flange 12. It is preferable to weld one of the transmission plates and the flange so that the welding strength becomes equal to or greater than ½ of the value obtained by subtracting the transmission strength from the web 13 from the allowable strength of the cross section of the flange 12.

Figure 3:
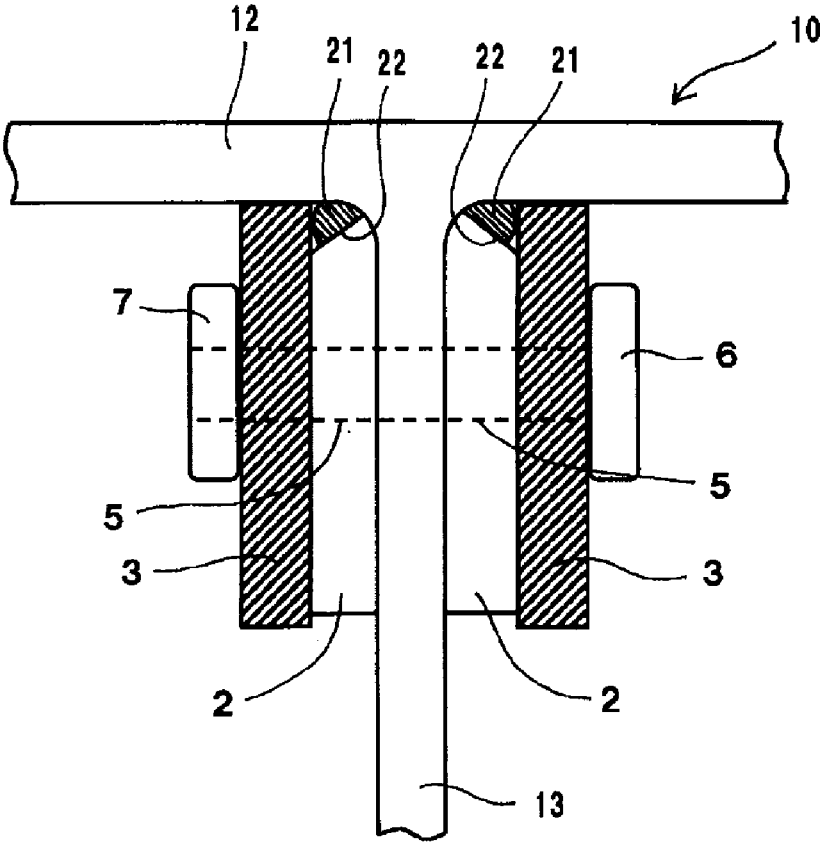
FIG. 3 is a partially enlarged view of FIG. 2.

Furthermore, in the first embodiment, the coupling plate 3 is provided in close contact with the front surface of the transmission plate 2, and hence it is desirable that a welding portion 21 between the transmission plate 2 and the flange 12 is welded so that a so-called bead, which rises along the edge of the transmission plate 2, does not project. In order to achieve such a welding state, for example, as illustrated in FIG. 3, a chamfered portion 22 can be formed in advance on the edge of the welding portion 21 of the transmission plate 2. The welding is usually performed by partial penetration welding so as to fill the chamfered portion 22, but by cutting a surplus portion, the transmission plate 2 and the coupling plate 3 can be provided in close contact with each other. Alternatively, it is possible to avoid contact with the ridge of the bead by forming a chamfered portion on the edge of the coupling plate 3 to be joined. The welding form of the welding portion 21 between the flange 12 and the transmission plate 2 is not particularly limited, but in consideration of the above point, it is desirable to perform surplus cutting by partial penetration welding.

The transmission plate 2 having the same width is arranged at a corresponding position where each transmission plate 2 is arranged in the joint with the adjacent H-beams 10 and 11. Specifically, it can be arranged at a total of four places on the back sides of the upper and lower flanges 12 on both sides across the web 13. Furthermore, the transmission plate 2 needs to have a thickness and a welding length that can sufficiently give the welding strength of the back side of the flange 12 and the transmission plate 2. The welding length is determined by the number and interval of the bolts 6. Since the thinner the transmission plate 2 is, the shorter the length of the bolt 6, which is more economical, it is preferable to ensure a large welding length by increasing the interval of the bolts 6 or the like.

The coupling plate 3 is a member that joins the webs 13 to each other via corresponding transmission plates 2 of the adjacent H-beams 10 and 11. The web 13 is joined via the transmission plate 2 by friction joint using the bolt 6 or the like. Specifically, a through-hole 5 coaxially penetrating through the coupling plate 3, the transmission plate 2, and the web 13 is provided at a predetermined position of a part where the transmission plate 2 and the coupling plate 3 overlap, and the through-hole 5 is inserted with the bolt 6 and tightened with the nut 7 to frictionally join them. At this time, the strength of the coupling plate 3 and the strength of the bolt joining require a larger one of the strengths of ½ of the magnitude obtained by dividing the allowable bending moment of the H-beam by the distance between bolt axes and ¼ of the allowable axial force of the H-beam.

As for the bolt 6, the thickness, the strength, and the number of the high-strength bolt is determined in accordance with the necessary strength. At this time, the length and thickness of the transmission plate 2 can be designed by varying the pitch and the number of the bolts 6. The longer the transmission plate 2 is, the greater the strength transmitted from the joint between the web 13 and the flange 12 is, and the more the welding length with the flange 12 can be ensured. Hence, it is possible to reduce the welding size and to thin the transmission plate 2, which is economic because the bolt 6 can be shortened in length.

As for the coupling plate 3, the material strength and the cross-sectional area are determined in accordance with the necessary strength. At this time, the thinner the coupling plate 3 is, the shorter the length of the bolt 6 can be, which is economic. However, it is necessary to pay attention to a deviation from the bolt axial core because the width becomes wide in order to obtain a necessary cross sectional area. At this time, by forming a plurality of lines of the bolts 6 in the web 13 direction, the inter-axis distance of the bolts 6 is shortened and the necessary strength is increased. Although the transmission plate 2 is also shortened, the width of the coupling plate 3 can be widened. From the viewpoint of increasing the strength of the frictional joint, it is desirable to apply red rust treatment or blasting treatment to the joining surface of the coupling plate 3 with the transmission plate 2.

It is desirable to carry out an appropriate design option depending on the size of the H-beams 10 and 11 to be joined. In the first embodiment illustrated in FIG. 1, two of the bolts 6 are used for one transmission plate.

In friction joint, generally, the more the friction surface is, the greater the joining strength becomes. For example, a two-face shear friction joint is given twice the strength of a one-face shear friction joint of a high-strength bolt in the building standards. In the H-beam joint structure of the first embodiment, one friction surfaces of the transmission plate 2 and the coupling plate 3 are joined from both sides of the web 13 by one high-strength bolt, so that the high-strength bolt joint of the H-beam 10 and the H-beam 11 becomes a two-face shear friction joint.

The force transmitted to the transmission plate 2 welded to four places of the back surfaces of the upper and lower flanges 12 on both sides across the web 13 is transmitted to the flange 12 from the welding 21. However, the force transmitted to the transmission plate 2 is also transmitted to the web 13 because the transmission plate 2 and the web 13 are fastened together by the high-strength bolt 6, and the force is transmitted to the flange 12 from the joint between the web 13 and the flange 12.

The force transmitted from the coupling plate 3 to the transmission plate 2 by the joining of the H-beam 10 and the H-beam 11 is transmitted to the flange 12 via the welding portion 21 between the web 13 and the transmission plate 2. Therefore, only in the area surrounded by the back side of the flange 12 and the web 13, it is possible to provide the joining so that the bending moment, the axial force, and the shearing force applied to the H-beams 10 and 11 can be transmitted, and it is possible to provide the joining with an equivalent strength to the conventional joining strength with a small number of components. This is due to the joint between the transmission plate 2 and the flange 12 by the welding 21 and the comprehensive bonding force that fastening the web 13, the transmission plate 2, and the coupling plate 3 together by the high-strength bolt 6.

In the H-beam joint mechanism of the first embodiment, the transmission plate 2 is welded to the back surface of the flange 12, and it is thus possible to make a flat surface having no step due to projection by the bolt 6 or an attachment plate, and to improve the workability to the front surface side of the flange 12.

Second Embodiment

Figure 4:
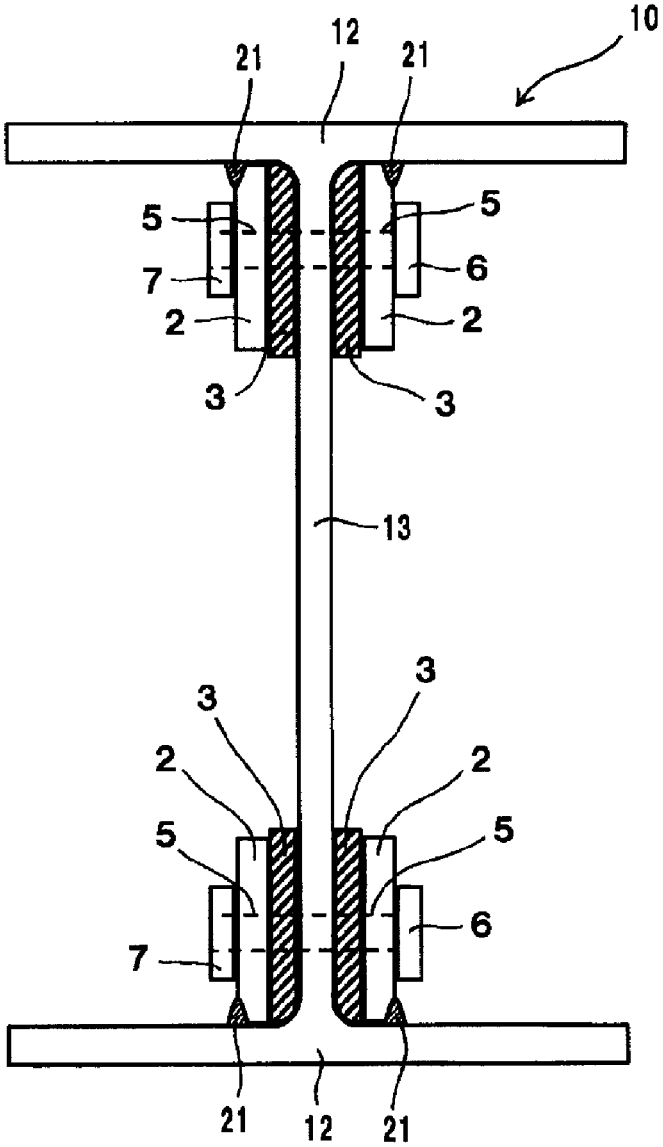
FIG. 4 is a schematic cross-sectional view illustrating a second embodiment of the H-beam joint structure of the present invention.
Figure 5:
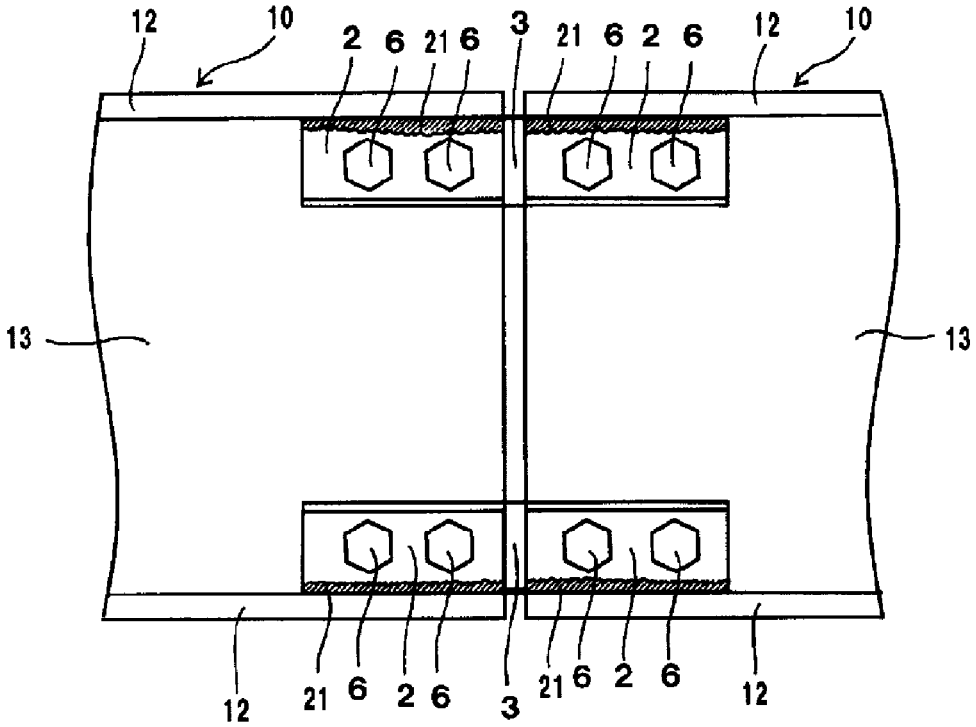
FIG. 5 is a schematic side view of the second embodiment.

In the present invention, the H-beam joint structure according to the second embodiment as illustrated in FIGS. 4 and 5 is also possible. In the second embodiment, the transmission plate 2 is provided by being welded to the back surface of the flange 12 at an interval corresponding to the thickness of the coupling plate 3 from the front surface of the web 13, and the coupling plate 3 is provided in close contact between the transmission plate 2 and the web 13. That is to say, the coupling plate 3 is held between the transmission plate 2 and the web 13.

The welding of the transmission plate 2 is only required to be performed at a strength of equal to or greater than ½ of the strength transmitted from the joint between the web 13 and the flange 12, and in order to avoid interference between the coupling plate 3 and the weld surplus, the back surface of the flange 12 and the transmission plate 2 are preferably fillet-welded from the outside, but may be partially penetration-welded from the outside if necessary.

The cross-sectional shape of the coupling plate 3 provided in close contact with the web 13 is a shape that is in close contact with the cross-sectional shape of the joint between the flange 12 and the web 13, and for example, when the joint between the flange 12 and the web 13 is formed into a cross-sectional circular arc shape, the shape of the corresponding abutting portion of the coupling plate 3 is also formed or chamfered into a cross-sectional circular arc shape in close contact with the joint.

According to the second embodiment, a two-face friction surface is formed on each of the both sides of the web 13, and this two coupling plates are bolted together from both sides of the web 13 by the high-strength bolt 6 and the nut 7, and hence the coupling plate 3 joining the H-beam 10 and the H-beam 11 becomes four-face shear friction joint by the high-strength bolt 6. Therefore, the number of bolts 6 can be halved as compared with the two-face shear friction joint of the first embodiment.

Third Embodiment 1

Furthermore, in the present invention, a plurality of the transmission plates 2 are provided at an interval corresponding to the thickness of the coupling plate 3, and the coupling plate 3 can be provided so as to be held in close contact between the web 13 and the transmission plate 2 and/or between the plurality of the transmission plates 2.

Figure 6:
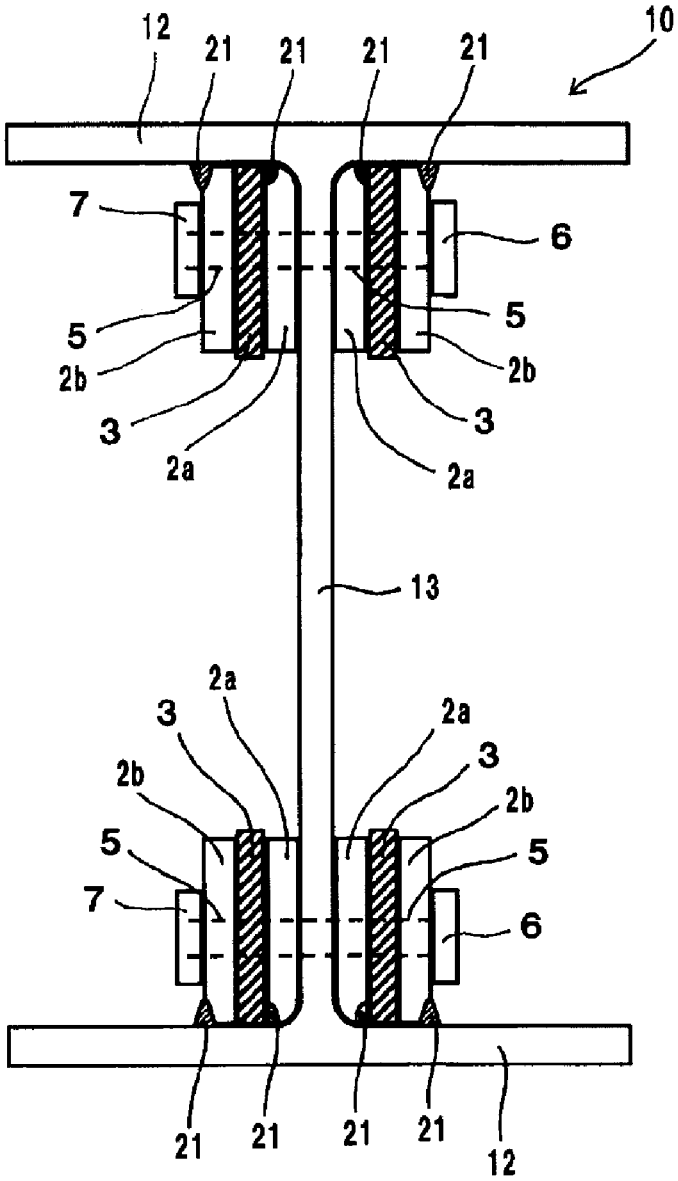
FIG. 6 is a schematic cross-sectional view illustrating a third embodiment 1 of the H-beam joint structure of the present invention.

Specifically, for example, the H-beam joint structure according to the third embodiment 1 as illustrated in FIG. 6 can be configured. In the H-beam joint structure according to the third embodiment 1, the web 13 and a transmission plate 2*a* are provided in close contact with each other as in the first embodiment, and a transmission plate 2*b* is further provided on the outside thereof at an interval corresponding to the thickness of the coupling plate 3. The transmission plates 2*a* and 2*b* are each welded to the back side of the flange 12 at the welding portion 21. The coupling plate 3 is provided so as to be held in close contact between the transmission plate 2*a*, which is in close contact with the web 13, and the transmission plate 2*b*, which is provided on the outside at the interval.

In the configuration of the third embodiment 1, on one side of the web 13, a two-face friction surface of the friction surface between the transmission plate 2*a* and the coupling plate 3 and the friction surface between the coupling plate 3 and the transmission plate 2*b* is formed. On both sides of the web 13, and they are joined by four-face shear friction joint by the friction surfaces of a total of four surfaces. As a result, the number of bolts 6 can be halved as compared with the two-face shear friction joint of the first embodiment.

Third Embodiment 2

Figure 7:
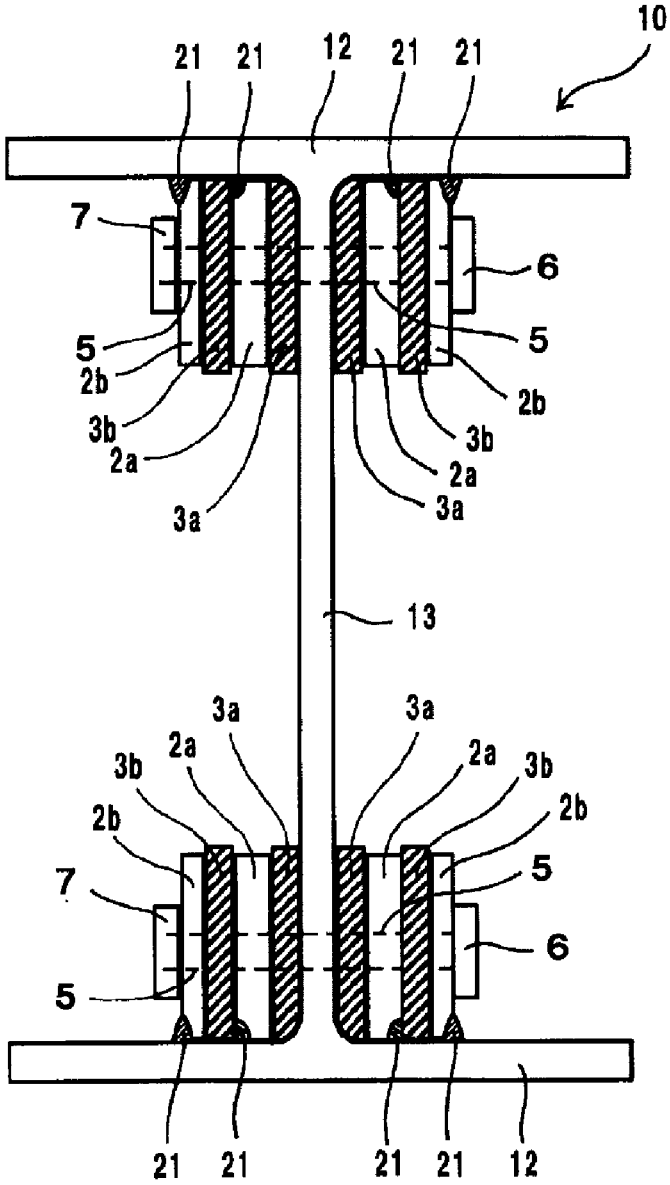
FIG. 7 is a schematic cross-sectional view illustrating a third embodiment 2 of the H-beam joint structure of the present invention.

As the third embodiment 2, as illustrated in FIG. 7, it is possible that the transmission plate 2*a* is provided by being welded to the back surface of the flange 12 at an interval corresponding to the thickness of a coupling plate 3*a* from the front surface of the web 13 as in the second embodiment, the transmission plate 2*b* is provided outside of the transmission plate 2*a* with an interval corresponding to the thickness of the coupling plate 3*b*, the coupling plate 3*a* is provided in close contact between the transmission plate 2*a* and the web 13, and a coupling plate 3*b* is further provided between the transmission plate 2*a* and the second transmission plate 2*b*. According to this structure, four of the coupling plates 3 are joined on both sides of the web 13, and eight-face shear friction joint is applied by a total of eight friction surfaces, thereby allowing them to be joined more strongly.

Fourth Embodiment

Figure 8:
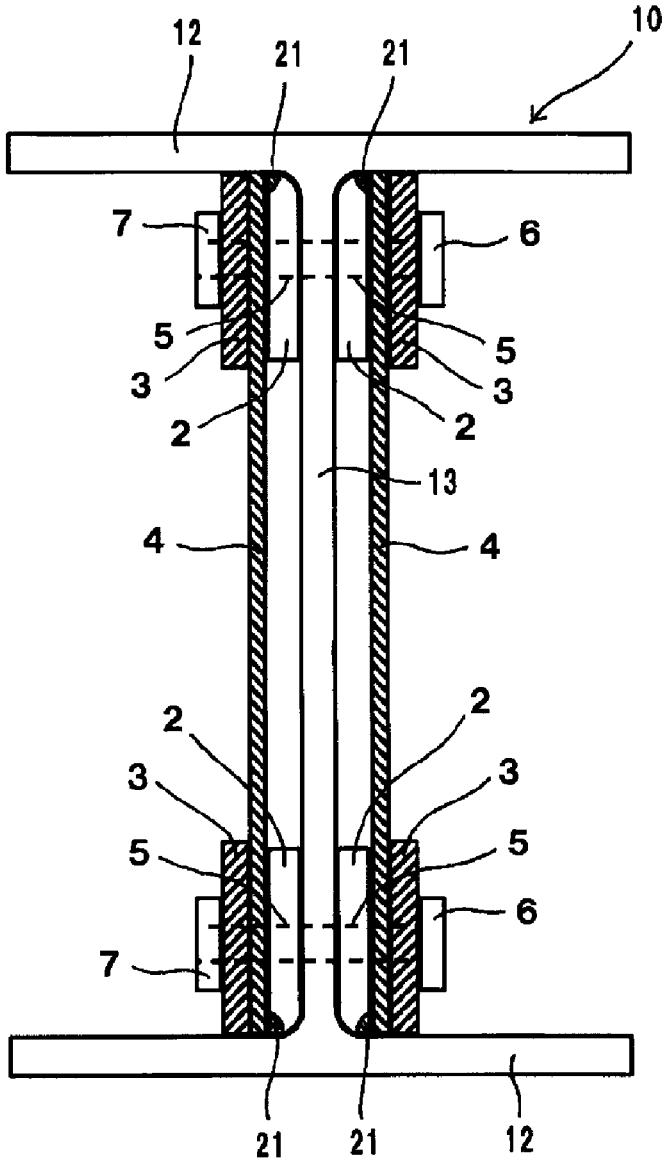
FIG. 8 is a schematic cross-sectional view illustrating a fourth embodiment of the H-beam joint structure of the present invention.
Figure 9:
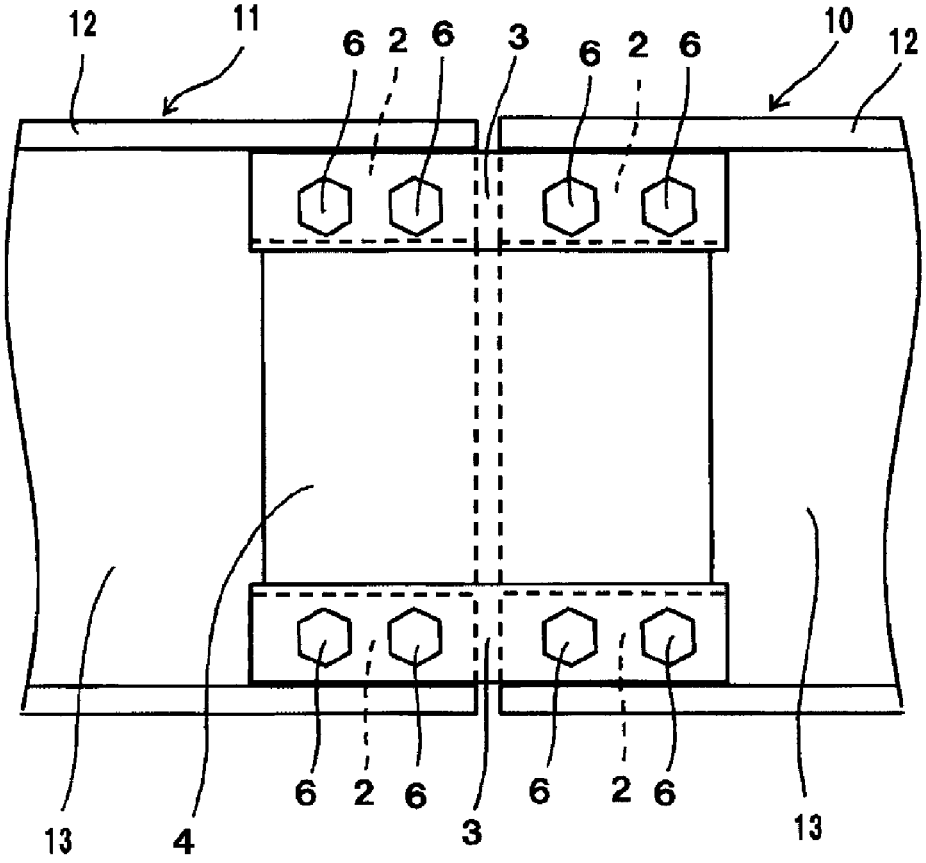
FIG. 9 is a schematic side view of the fourth embodiment.

In the present invention, when the shearing force cannot be transmitted only by the cross section of the coupling plate 3, or when transmission of a higher shearing force is required, a shearing coupling plate 4 can be provided to be held between the upper and lower coupling plates 3 or outside the coupling plates, as illustrated in FIGS. 8 and 9. This allows a large shearing force to be transmitted.

In the H-beam joint structure of the present invention, in addition to the structure represented by the first to fourth embodiments, in which the end of the H-beam and the end of another member are joined to each other, it is also possible to adopt a configuration in which the end of the H-beam and a portion other than the end of another structure are joined.

Fifth Embodiment

Figure 10:
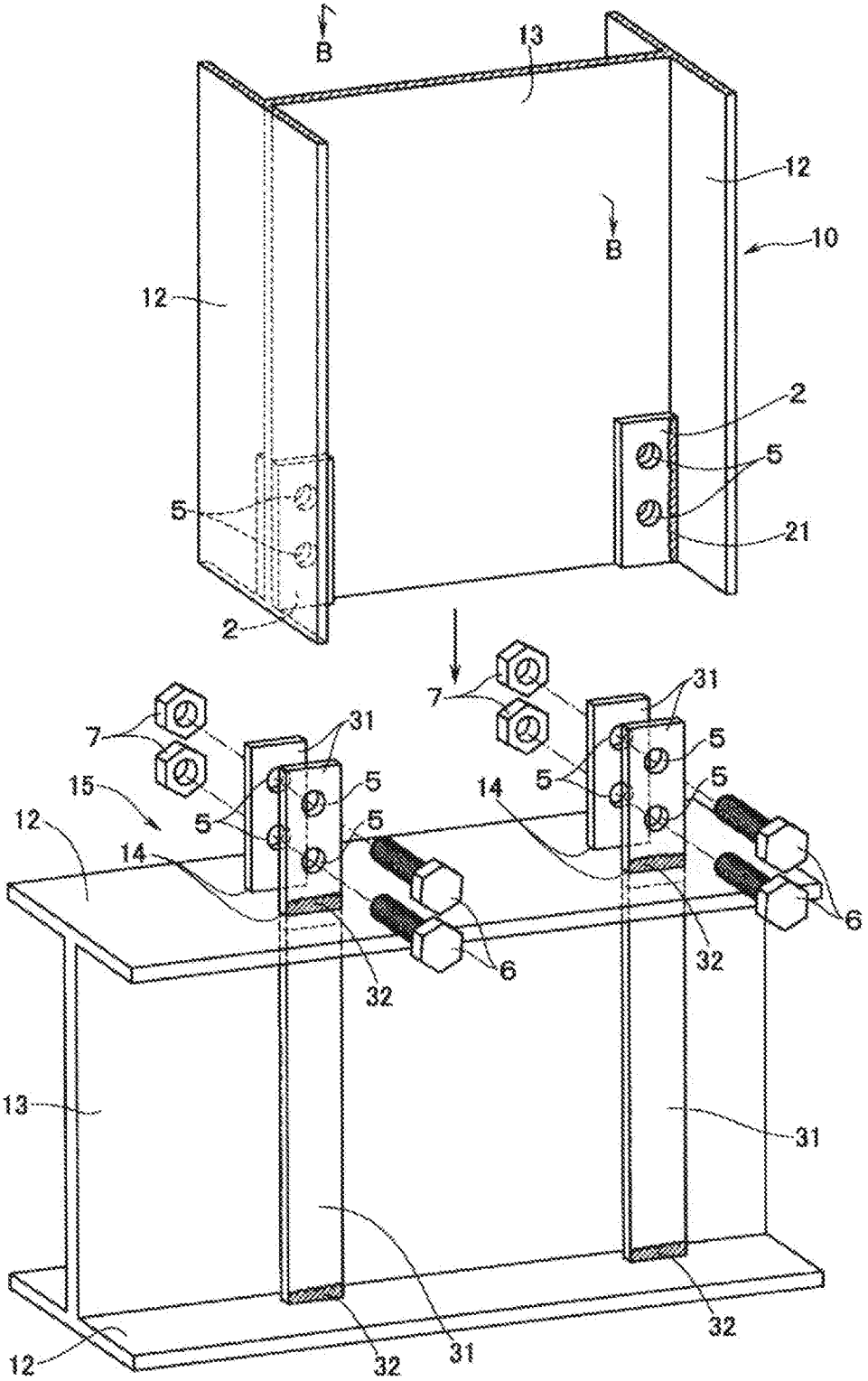
FIG. 10 is an exploded perspective view illustrating a fifth embodiment of the H-beam joint structure of the present invention.
Figure 11:
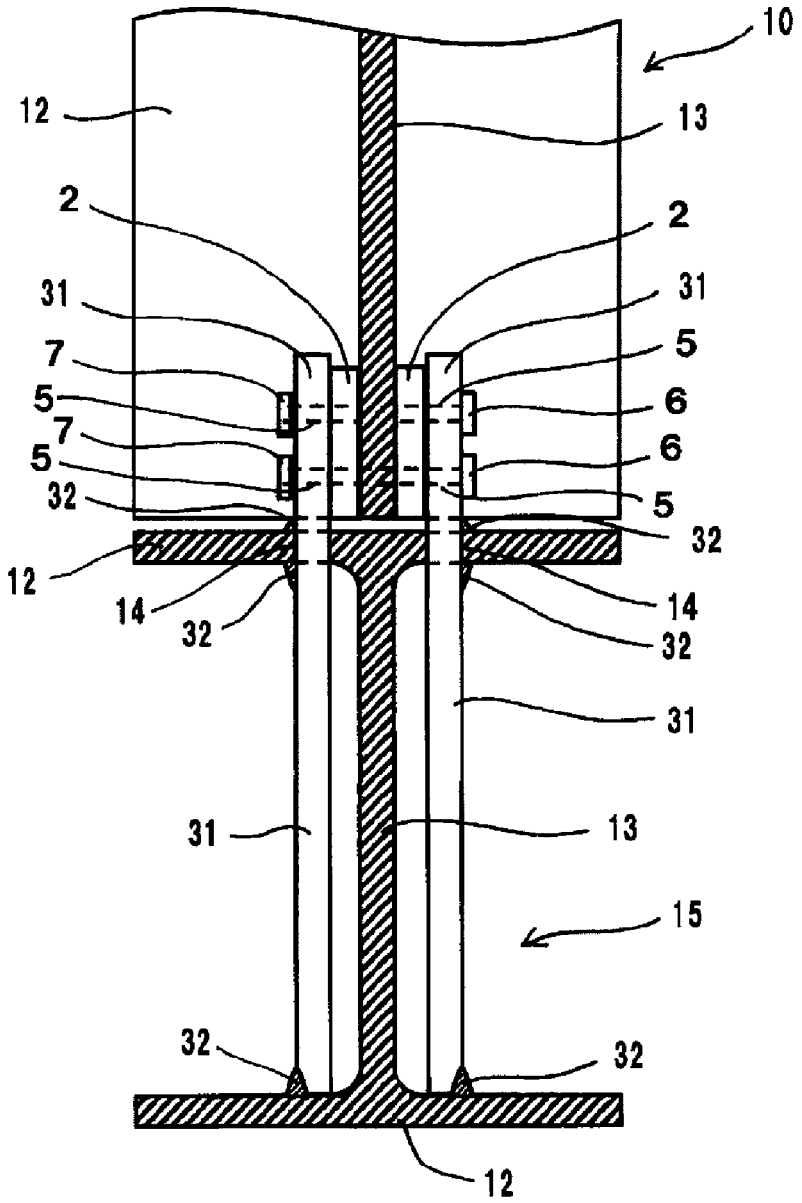
FIG. 11 is a B-B cross-sectional view of the fifth embodiment of FIG. 10 after joining.

FIG. 10 illustrates an exploded perspective view of the fifth embodiment, and FIG. 11 illustrates a B-B sectional view after joining of FIG. 10. The fifth embodiment illustrates a state in which the columnar H-beam 10 is vertically joined to the flange 12 of a beam-like H-beam 15 as a horizontally arranged structure. As in the first embodiment, the transmission plate 2 is welded along the longitudinal direction to the back surface of the flange 12 at the end of the vertically arranged H-beam 10 so that the transmission plate 2 is in close contact with the front surface of the web 13. The welding of the transmission plate 2 to the back surface of the flange 12 can be performed in the similar manner to that in the first embodiment.

The horizontally arranged H-beam 15 is provided in advance with a coupling plate 31 so as to project from the flange 12 vertically to the longitudinal direction. Specifically, the coupling plate 31 is inserted into an insertion holes 14 provided on both sides of the upper flange 12 across the webs 13, and one end thereof is welded and fixed to a welding portion 32 on the back side of the lower flange 12. In the present embodiment, the upper flange 12 and the coupling plate 31 are also welded.

The coupling plate 31 welded to the horizontally arranged H-beam 15 and the transmission plate 2 of the vertically arranged H-beam 10 are joined in a state where they are closely fitted. That is to say, the interval across the web 13 of the coupling plate 31 welded to the horizontally arranged H-beam 15 is equal to the total thickness of the web 13 of the vertically arranged H-beam 10 and two of the transmission plate 2, which is the interval where the coupling plate 31 and the front surface of the transmission plate 2 are in close contact with each other in the fitted state.

The through-hole 5, which coaxially penetrates the coupling plate 31, the transmission plate 2, and the web 13, is provided at a predetermined position in a part where the transmission plate 2 and the coupling plate 31 overlap with each other in a state where the vertically arranged H-beam 10 is fitted to the other end of the coupling plate 31 which is not welded, and the through-hole 5 is inserted with the bolt 6 and tightened by the nut 7 to be frictionally joined. It should be noted that the conditions of the bolt joint can be determined under the same conditions as in the first embodiment. Thus, the horizontally arranged H-beam 15 and the vertically arranged H-beam 10 can be joined with an equivalent joining strength to that of the conventional joint structure, the number of components can be reduced, the joining work can be facilitated, and the surface side of each flange 12 can be flattened.

Sixth Embodiment

Figure 12:
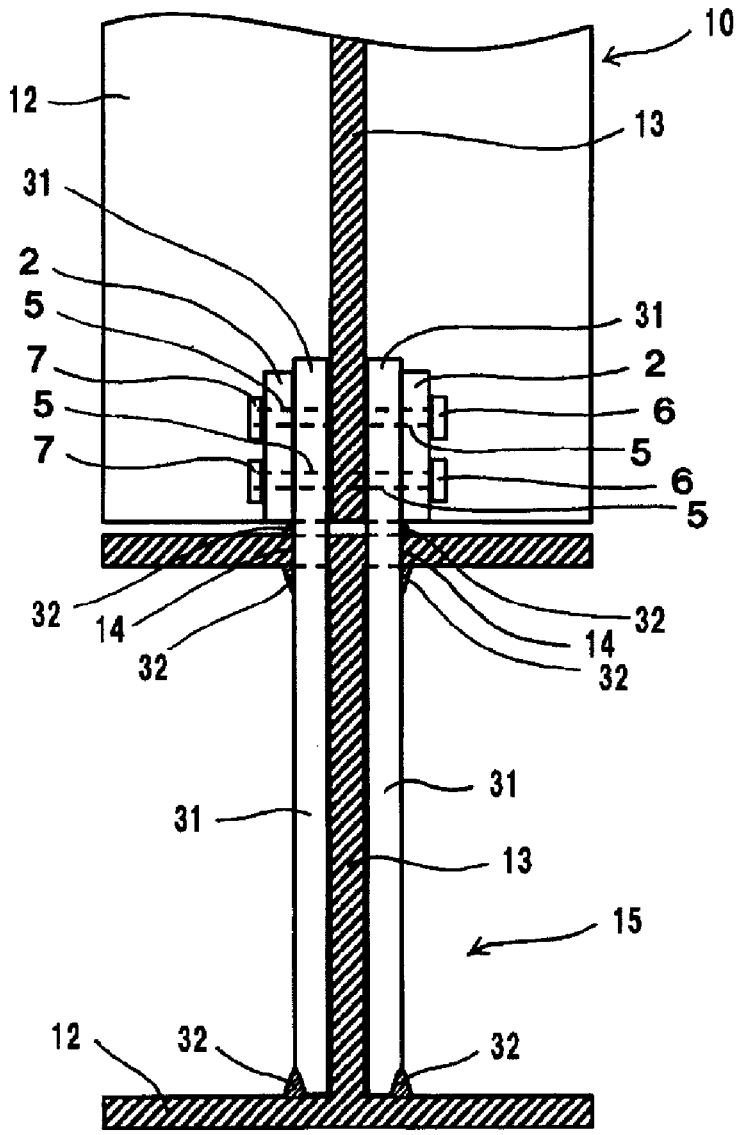
FIG. 12 is a schematic cross-sectional view illustrating a sixth embodiment of the H-beam joint structure of the present invention.
Figure 13:
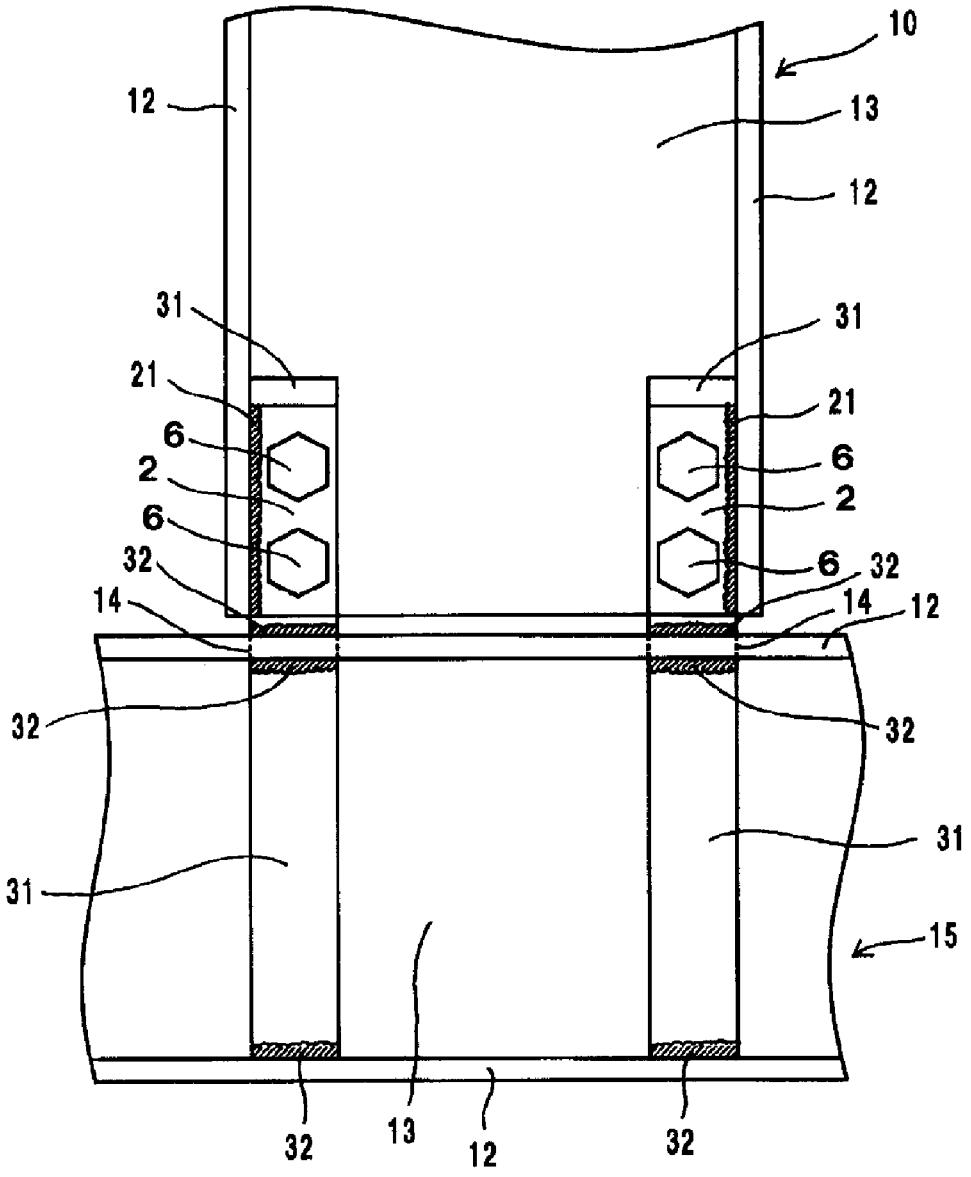
FIG. 13 is a schematic side view of the sixth embodiment.

In the present invention, the H-beam joint structure according to the sixth embodiment as illustrated in FIGS. 12 and 13 is possible. In the sixth embodiment, as in the second embodiment, the end of the vertically arranged H-beam 10 is provided with the transmission plate 2 by being welded to the back surface of the flange 12 at an interval corresponding to the thickness of the coupling plate 31 from the front surface of the web 13, and the end of the coupling plate 31 is provided in close contact between the transmission plate 2 and the web 13. That is to say, the coupling plate 3 is held between the transmission plate 2 and the web 13, and is bolted. The coupling plate 31 is inserted into the insertion hole 14 provided in the upper flange 12 of the horizontally arranged H-beam 15, is provided in close contact with the web 13, and is welded to the upper and lower flanges 12.

According to the sixth embodiment, at the end of the vertically arranged H-beam 10, as in the second embodiment, on one side of the web 13, the contact surfaces of the coupling plate 31 and the transmission plate 2 are the two-face friction surfaces, and the friction surfaces of a total of four surfaces on both sides of the web 13, and these two coupling plates are bolted together from both sides of the web 13 by the high-strength bolt 6 and the nut 7, and thus the H-beam 10 and the coupling plate 31 become four-face shear friction joint by the high-strength bolt. Therefore, the number of bolts 6 can be halved as compared with the two-face shearing joint of the fifth embodiment.

Seventh Embodiment 1

Furthermore, in the present invention, as the seventh embodiment 1, as in the third embodiment 1, a plurality of the transmission plates 2 are provided at an interval corresponding to the thickness of the coupling plate 3 at the end of the vertically arranged H-beam, and the coupling plate 3 can be provided so as to be held in close contact between the web 13 and the transmission plate 2 and/or the plurality of transmission plates 2.

Figure 14:
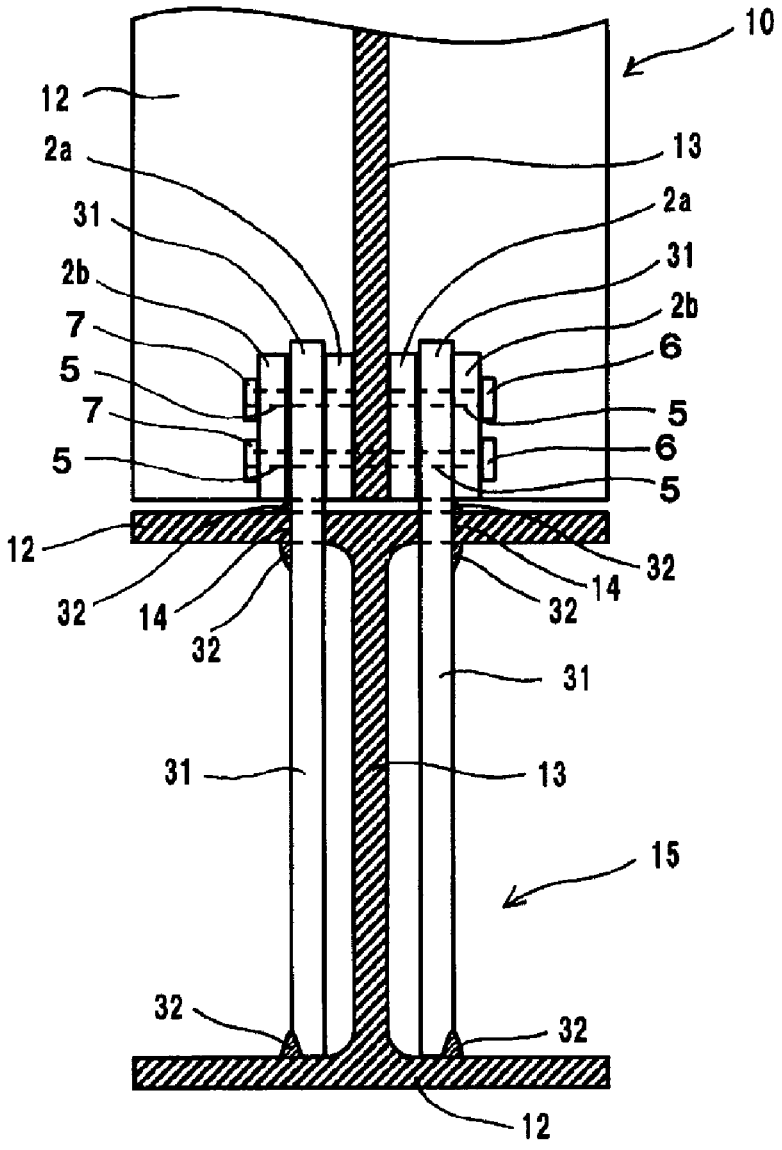
FIG. 14 is a schematic cross-sectional view illustrating a seventh embodiment 1 of the H-beam joint structure of the present invention.

Specifically, for example, the H-beam joint structure as illustrated in FIG. 14 can be configured. In the H-beam joint structure according to the seventh embodiment 1, the web 13 and the transmission plate 2*a* are provided in close contact with each other as in the third embodiment 1, and the transmission plate 2*b* is further provided on the outside thereof at an interval corresponding to the thickness of the coupling plate 31. Then, the coupling plate 31 is held in close contact between the transmission plate 2*a*, which is in close contact with the web 13, and the transmission plate 2*b*, which is provided at an interval outside, and bolted. The coupling plate 31 is inserted into the insertion hole 14 provided in an upper flange 12 of the horizontally arranged H-beam and welded to the upper and lower flanges 12, at an interval of the thickness corresponding to the web 13 of the vertically arranged H-beam 10 and a total of two of the transmission plates 2*a*.

In the configuration of the seventh embodiment 1, on one side of the web 13, a friction surface of a total of two surfaces of the friction surface between the transmission plate 2*a* and the coupling plate 31 and the friction surface between the coupling plate 31 and the transmission plate 2*b* is formed. These two coupling plates are bolted together from both sides of the web 13 by the high-strength bolt 6 and the nut 7, and hence the H-beam 10 and the coupling plate 31 become in four-face shear friction joint by the high-strength bolt. Therefore, similarly to the sixth embodiment, the number of bolts 6 can be halved as compared with the two-face shear friction joint of the fifth embodiment.

Seventh Embodiment 2

As another seventh embodiment 2 that is not illustrated, similarly to the third embodiment 2, it is possible that the transmission plate 2 is provided by being welded to the back surface of the flange 12 at an interval corresponding to the thickness of the coupling plate 31 from the front surface of the web 13, the transmission plate 2 is provided outside of the transmission plate 2 with an interval corresponding to the thickness of the coupling plate 31, the coupling plate 31 is provided in close contact between the transmission plate 2 and the web 13, and the coupling plate 31 is further provided between two of the transmission plates 2. According to this structure, four of the coupling plates 31 are joined on both sides of the web 13, and eight-face shear friction joint is applied by a total of eight friction surfaces, thereby allowing them to be joined more strongly. It should be noted that the welding position of the coupling plate 31 with respect to the horizontally arranged H-beam 15 is the position where the above-described state is given.

Eighth Embodiment

Figure 15:
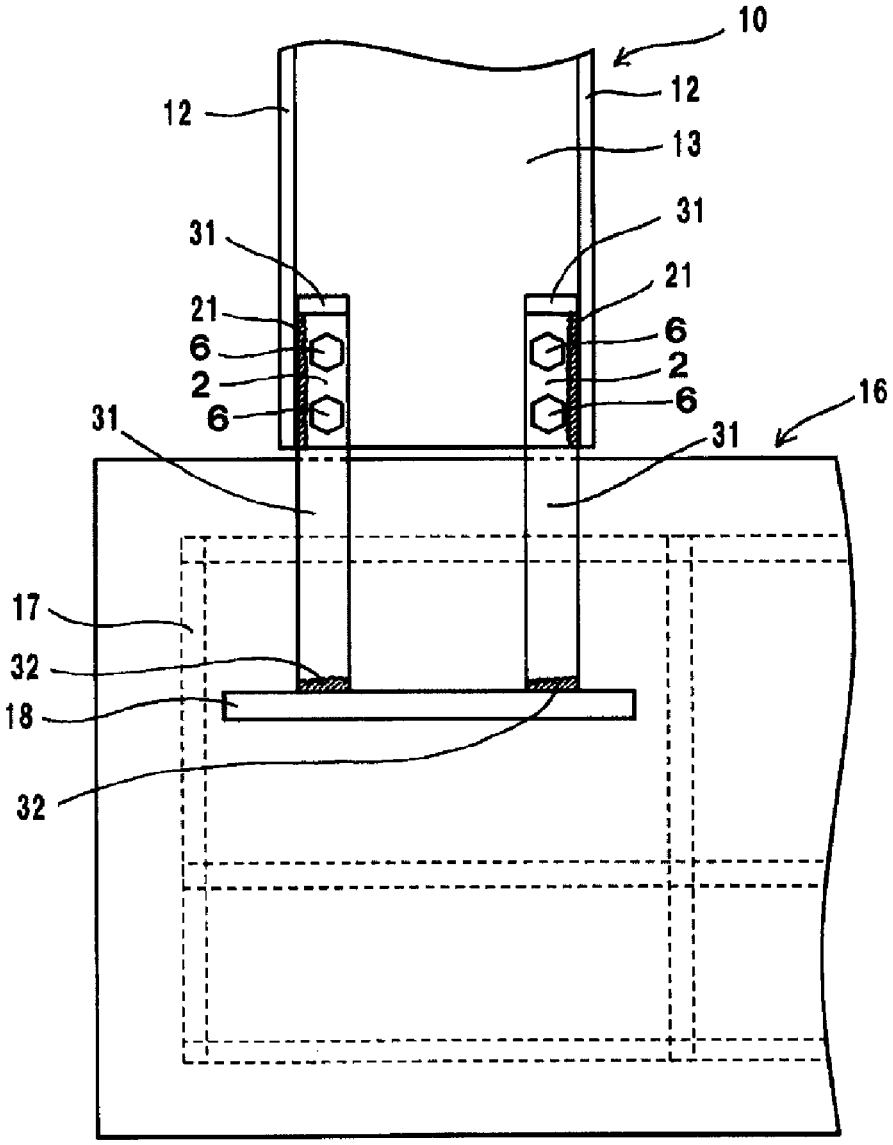
FIG. 15 is a schematic side view illustrating an eighth embodiment of the H-beam joint structure of the present invention.

As illustrated in FIG. 15, as the eighth embodiment, the coupling plate 31 can be welded vertically to a foundation anchor plate 18 serving as a column base anchor of the structure of a foundation 16, and the coupling plate 31 can be surrounded by reinforcing steel 17 or the like to be firmly integrated with concrete. The end of the coupling plate 31 projected from the foundation 16 is bolted to the web 13 of the vertically arranged H-beam 10 and the coupling plate 2. At this time, the arrangement of the coupling plate 31 welded to the foundation anchor plate 18, which is a structure embedded in the transmission plate 2 of the H-beam 10 and the foundation 16, can be any of the configurations of the above-described fifth to seventh embodiments according to the design and the like.

Ninth Embodiment

Figure 16:
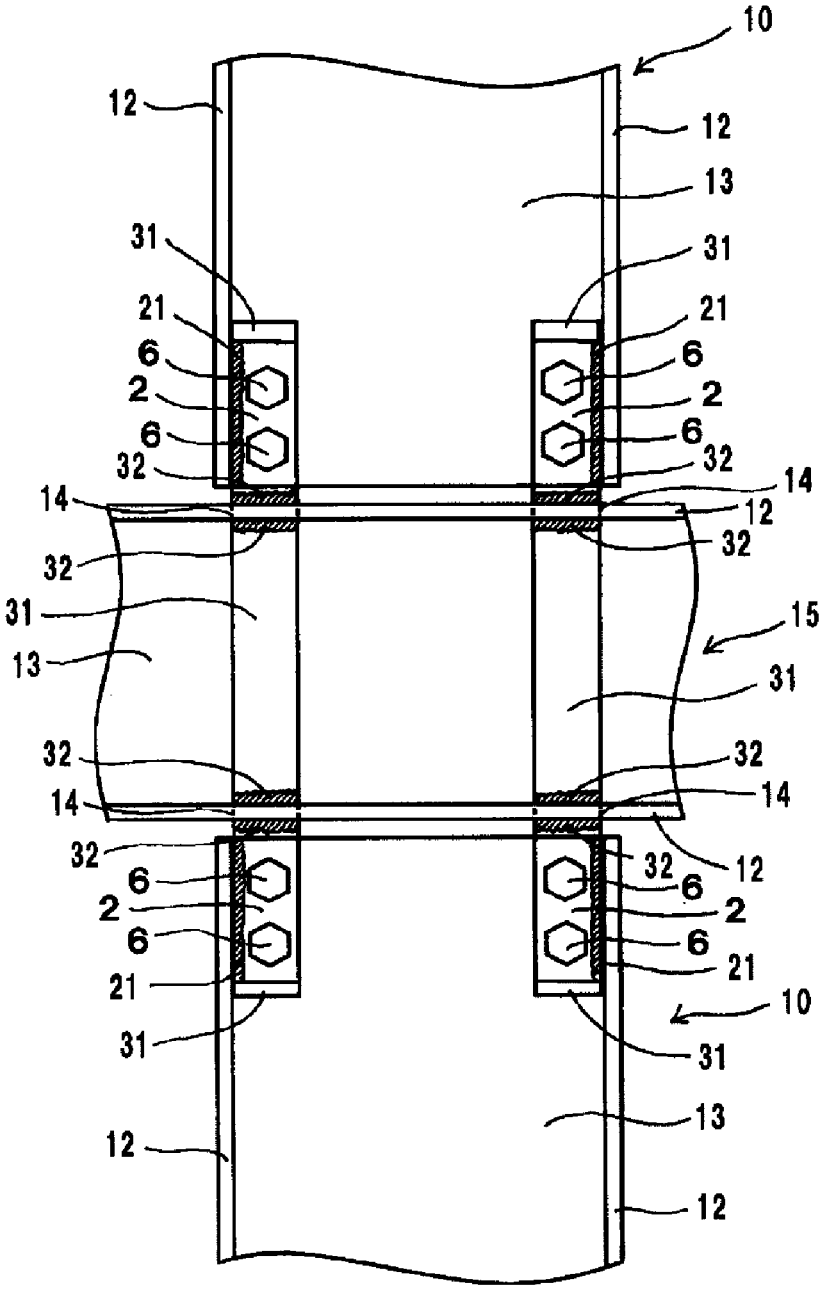
FIG. 16 is a schematic side view illustrating a ninth embodiment of the H-beam joint structure of the present invention.

As the ninth embodiment, as illustrated in FIG. 16, in the horizontally arranged H-beam 15, it is possible that the coupling plate 31 is inserted and welded into the insertion holes 14 provided in the upper and lower flanges 12, and joined so as to be held vertically by the vertically arranged H-beam 10 with respect to the horizontally arranged H-beam 15. Also in this configuration, the arrangement configuration of the transmission plate 2 of the H-beam 10 and the coupling plate 31 welded to the H-beam 15 can be any of the configurations of the above-described fifth to seventh embodiments according to the design and the like.

Tenth Embodiment

Figure 17:
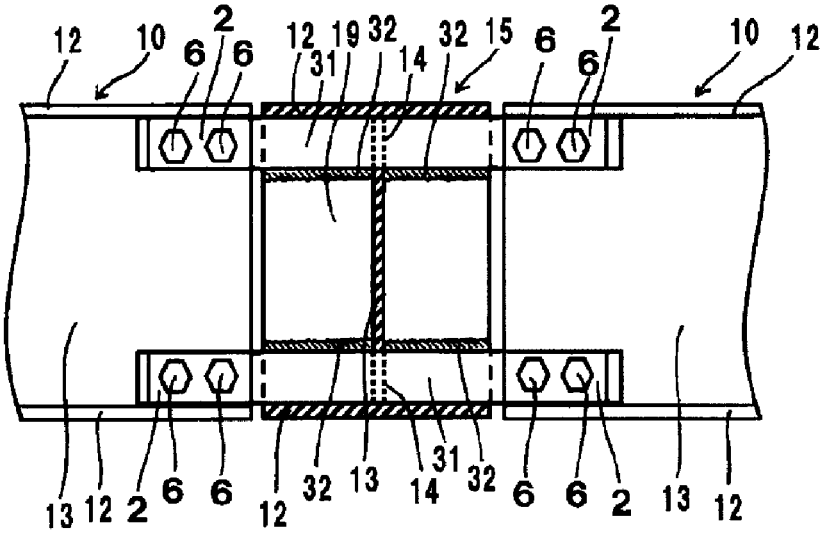
FIG. 17 is a schematic side view illustrating a tenth embodiment of the H-beam joint structure of the present invention.

As the tenth embodiment, as illustrated in FIG. 17, it is possible that a stiffener 19 is provided in the vertical direction with respect to the web 13 of the horizontally arranged H-beam 15, and the coupling plate 31 inserted into the web 13 is welded or bolted to the stiffener 19, and bolted so as to be held from horizontally by the H-beams 10 and 11 arranged horizontally and vertically, respectively, with respect to the horizontally arranged H-beam 15.

Thus, the shearing force applied to the H-beams 10 and 11 is transmitted to the H-beam 15, and the axial force and the bending moment are mutually transmitted by the coupling plate 31 to the H-beams 10 and 11 opposed to each other. Also in this configuration, the arrangement configuration of the transmission plates 2 of the H-beams 10 and 11 and the coupling plate 31 welded to the stiffener of the H-beam 15 can be any of the configurations of the above-described fifth to seventh embodiments according to the design and the like.

In the H-beam joint structure of the present invention, as another embodiment, can have an H-beam joint structure for joining an end of the H-beam 10 and an end of the steel material 11 that is adjacent to the H-beam 10 and has at least the flange 12 and the web 13, and the H-beam joint structure includes the transmission plate 2 arranged parallel to a front surface of the web 13 at least one side of the web 13 of the H-beam 10 and the steel material 11, and welded to a back surface of the flange 12, and the coupling plate 3 connecting the H-beam 10 and the steel material 11 on the opposite side to the web 13 on the side where the transmission plate 2 is arranged, in which the web 13 and the transmission plate 2 of the H-beam 10 are bolted to those of the steel material 11 via the coupling plate 3. As an embodiment of the above configuration, FIG. 18 illustrates the H-beam joint structure according to the eleventh embodiment.

Eleventh Embodiment

Figure 18:
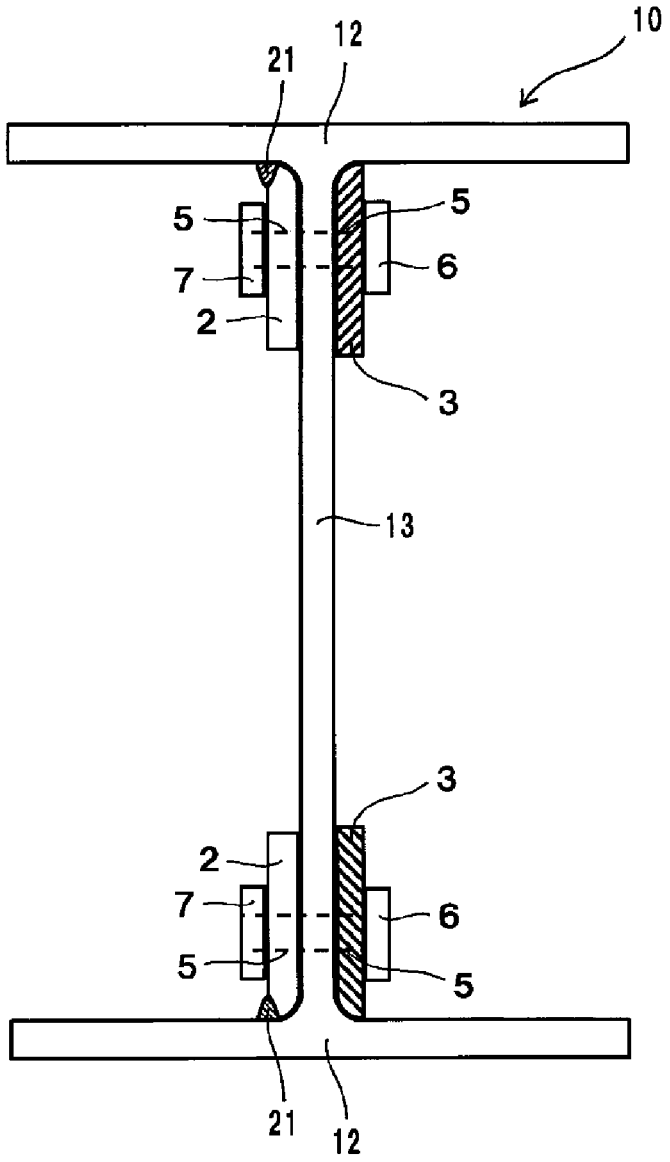
FIG. 18 is a schematic cross-sectional view illustrating an eleventh embodiment of the H-beam joint structure of the present invention.

In the H-beam joint structure according to the eleventh embodiment illustrated in FIG. 18, the transmission plate 2 is welded along the longitudinal direction to the back surface of the flange 12 and is provided so as to come into close contact with the front surface of the web 13. Then, on the opposite side of the web 13 where the transmission plate 2 is arranged, the coupling plate 3 is provided so as to come into close contact with the front surface of the web 13.

According to the eleventh embodiment, the transmission plate 2, the web 13, and the coupling plate 3 are bolted together by the high-strength bolt 6 and the nut 7, and one side of the web 13 is given one-face shear friction joint of one side of the coupling plate 3 and the web 13, and hence a simple and low-cost joint structure in which core misalignment between the coupling plate 3 and the H-beam 10 is minimized.

Twelfth Embodiment

Figure 19:
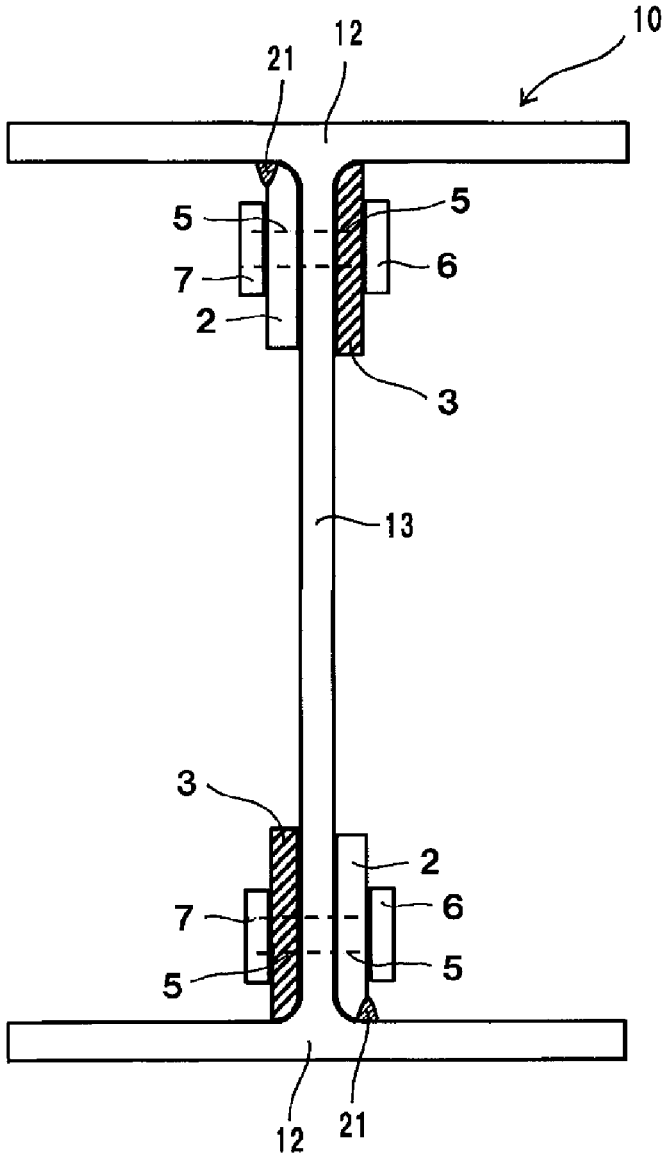
FIG. 19 is a schematic cross-sectional view illustrating a twelfth embodiment of the H-beam joint structure of the present invention.
Figure 20:
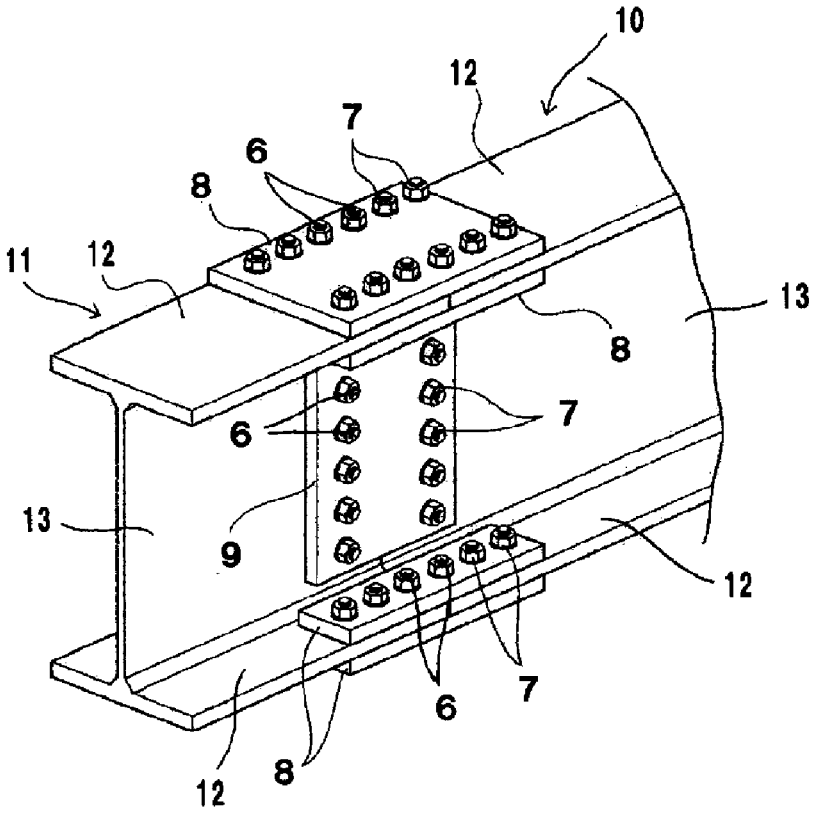
FIG. 20 is a schematic perspective view illustrating a conventional H-beam joint structure.

Furthermore, in the H-beam joint structure according to the twelfth embodiment illustrated in FIG. 19, the arrangement position of the transmission plate 2 and the coupling plate 3 welded to the flange 12 is provided vertically on the opposite side of the web 13 in the one-face shear friction joint between the coupling plate 3 and one face of the web 13 illustrated in FIG. 18. According to the twelfth embodiment, the one-face shear friction joint between the coupling plate 3 and one side of the web 13 is balanced vertically, and the core misalignment (displacement of the center of stress) can be eliminated.

While the H-beam joint structure of the present invention has been described on the basis of the embodiments, the present invention is not limited to the embodiments described above, and various modifications can be made without departing from the scope thereof.

For example, although the above embodiments adopt frictional joint by the bolt 6 and the nut 7, shear joint can be adopted by a fastener such as a rivet or a bolt. Although a high-strength bolt is usually used as the bolt 6, an ultra high-strength bolt can be used, which can reduce the number of the bolts 6. Furthermore, from the viewpoint of increasing the strength of the friction joint, the surface where the transmission plate 2 or the web 13 and the coupling plates 3 or 13 come into close contact with each other can be provided with red rust treatment or blasting treatment.

Furthermore, in the case where the joint between the flange 12 and the web 13 is formed in a cross-sectional circular arc shape, the shape of the corresponding edge of the transmission plate 2 and the coupling plates 3 or 31 in close contact with the joint is also formed in a cross-sectional circular arc shape or a chamfered cross-sectional shape. However, interference can be avoided by applying, to the web 13, a washer having a thickness enough to avoid the circular arc shape of the joint between the flange 12 and the web 13.

Furthermore, although in the fourth embodiment, one shearing coupling plate 4 is provided on one side of the web 13 and two shear plates 4 are provided on both sides of the web 13, a plurality of shearing coupling plates 4 can be provided on one side. The upper and lower coupling plates 3 and the shearing coupling plate 4 may be integrated.

Furthermore, in the first to fourth embodiments, the H-beam 11 is used as a steel material adjacent to the H-beam 10, and in the fifth to seventh and ninth embodiments, the horizontally arranged H-beam 15 is used as a structure. However, these are not limited to an H-beam, and may be an H-beam, a channel steel, a Z-beam, an I-beam, or a square steel tub. The H-beam 10 may be a channel steel, a Z-beam, or an I-beam.

Furthermore, in the first to fourth embodiments, the H-beam 11 adjacent to the H-beam 10 is joined as a horizontal beam, but each may be joined as a vertical column. In the above-described fifth to ninth embodiments, the H-beam 10 provided with the transmission plate 2 is arranged vertically, but the H-beam 10 provided with the transmission plate 2 may be arranged horizontally.

Furthermore, in the above-described first embodiment to third embodiment 2 and the fifth to tenth embodiments, the transmission plate 2 and the coupling plate 3 (31) are symmetrically provided on both sides of the web 13, and in the fourth embodiment, the transmission plate 2 and the shearing coupling plate 4 are symmetrically provided on both sides of the web 13. However in the present invention, in any of the first to tenth embodiments, the transmission plate 2 and the coupling plate 3 or 31 (shearing coupling plate 4) can be provided on only one side of the web 13.

Furthermore, in any of the first to tenth embodiments, the transmission plate 2 and the coupling plate 3 or 31 (shearing coupling plate 4) can be provided on only one side of the web 13, and only the coupling plate 3 can be provided separately on the surface opposite to the web 13 provided with them.

According to the H-beam joint structure of the present invention having the above-described configuration, it is possible to have a joining strength equivalent to that of a conventional H-beam joint structure, to reduce the number of components, to facilitate the joining work, and to flatten the front surface of the flange.

The invention claimed is:

1. An H-beam joint structure for joining an H-beam and a steel material, the steel material having at least a flange and a web, the H-beam joint structure comprising:

a first transmission plate arranged at an end of the steel material, the first transmission plate being parallel to a front surface of the web of the steel material and welded to a back surface of the flange of the steel material;

a second transmission plate arranged at an end of the H-beam that is immediately adjacent to the end of the steel material, the second transmission plate being parallel to a front surface of a web of the H-beam and welded to a back surface of a flange of the H-beam; and a coupling plate extending across and in direct contact with the first and second transmission plates to connect the H-beam and the steel material, wherein the web of the H-beam, the web of the steel material and the first and second transmission plates are bolted via the coupling plate by a plurality of first bolts and a plurality of second bolts, such that each first bolt extends through the coupling plate, the first transmission plate and the web of the steel material, and such that each second bolt extends through the coupling plate, the second transmission plate and the web of the H-beam.

2. The H-beam joint structure according to claim 1, wherein the first and second transmission plates are arranged by being welded to the back surface of the respective flanges at an interval corresponding to a thickness of the coupling plate from the front surface of the web of the steel material and the web of the H-beam, and the coupling plate is arranged so as to be held between the first and second transmission plates and the front surfaces of the web of the steel material and the web of the H-beam.

3. The H-beam joint structure according to claim 1, wherein the first and second transmission plates of the H-beam and the steel material are arranged at an interval corresponding to a thickness of the coupling plate, and the coupling plate is arranged so as to be held between the web of the steel material and the web of the H-beam on one side of the coupling plate and the first and second transmission plates on an opposite side of the coupling plate.

4. The H-beam joint structure according to claim 1, wherein the steel material is any of an H-beam, a channel steel, a Z-beam, and an I-beam.

5. The H-beam joint structure according to claim 1, wherein the first and second transmission plates and the coupling plate are positioned at an upper portion of the H-beam and the steel material, wherein the H-beam joint structure further comprises first and second lower transmission plates and a lower coupling plate extending across the first and second lower transmission plates.

6. The H-beam joint structure according to claim 5, wherein a shearing coupling plate, connecting the upper and lower transmission plates and the upper and lower coupling plates of the H-beam and the steel material, is provided between the upper and lower transmission plates and the upper and lower coupling plates of the H-beam and the steel material.

7. An H-beam joint structure for joining an H-beam and a steel material, the steel material having at least a flange and a web, the H-beam joint structure comprising:

a first transmission plate arranged at an end of the steel material, the first transmission plate being parallel to a front surface of the web of the steel material and welded to a back surface of the flange of the steel material;

a second transmission plate arranged at an end of the H-beam that is immediately adjacent to the end of the steel material, the second transmission plate being parallel to a front surface of a web of the H-beam and welded to a back surface of a flange of the H-beam; and a coupling plate connecting the H-beam and the steel material, the coupling plate being arranged on opposite sides of the web of the H-beam and the web of the steel material relative to sides of the web of the H-beam and the web of the steel material where the first and second transmission plates are arranged, wherein the coupling plate extends across the first and second transmission plates, and the web of the H-beam, the web of the steel material and the first and second transmission plates are bolted via the coupling plate by a plurality of first bolts and a plurality of second bolts, such that each first bolt extends through the coupling plate, the first transmission plate and the web of the steel material, and such that each second bolt extends through the coupling plate, the second transmission plate and the web of the H-beam.

8. The H-beam joint structure according to claim 7, wherein the first and second transmission plates are arranged in contact with the front surface of the web of the steel material and the front surface of the web of the H-beam, respectively, and the coupling plate is arranged in direct contact with the opposite side of the web of the H-beam and the web of the steel material.

9. The H-beam joint structure according to claim 7, wherein the steel material is any of an H-beam, a channel steel, a Z-beam, and an I-beam.

* * * * *